US007267513B2

(12) United States Patent
Wiker et al.

(10) Patent No.: US 7,267,513 B2
(45) Date of Patent: Sep. 11, 2007

(54) SPADE DRILL BIT

(75) Inventors: Juergen Wiker, Leinfelden-Echterdingen (DE); Gregory A. Phillips, LaGrange, KY (US)

(73) Assignee: Credo Technology Corporation, Broadview, IL (US)

( * ) Notice: Subject to any disclaimer, the term of this patent is extended or adjusted under 35 U.S.C. 154(b) by 0 days.

(21) Appl. No.: 10/547,642

(22) PCT Filed: Mar. 11, 2003

(86) PCT No.: PCT/US03/07184

§ 371 (c)(1),
(2), (4) Date: Sep. 1, 2005

(87) PCT Pub. No.: WO2004/080632

PCT Pub. Date: Sep. 23, 2004

(65) Prior Publication Data

US 2006/0083595 A1 Apr. 20, 2006

(51) Int. Cl.
*B27G 15/00* (2006.01)

(52) U.S. Cl. ..... 408/214; 408/227

(58) Field of Classification Search ..... 408/211, 408/212, 213, 214, 225, 227, 228; *B27G 15/00, B27G 15/02*

See application file for complete search history.

(56) References Cited

U.S. PATENT DOCUMENTS

| | | | | |
|---|---|---|---|---|
| 2,627,292 | A * | 2/1953 | Kronwall | 408/213 |
| 2,883,888 | A * | 4/1959 | Stewart | 76/102 |
| 5,221,166 | A * | 6/1993 | Bothum | 408/212 |
| 5,433,561 | A * | 7/1995 | Schimke | 408/211 |
| 2002/0127071 | A1 * | 9/2002 | Vasudeva | 408/213 |

FOREIGN PATENT DOCUMENTS

WO WO9805459 A1 * 2/1998

* cited by examiner

*Primary Examiner*—Daniel W. Howell
(74) *Attorney, Agent, or Firm*—Maginot, Moore & Beck

(57) ABSTRACT

A spade drill bit (202) comprises a shaft (204) having one end (205) configured to be engaged to a driving tool and a cutting head (206) attached at an opposite end of said shaft (204). The cutting head (206) includes a center point (216) having threads (240) defined thereon, including continuous threads (247) adjacent the tip and discontinuous threads (242) thereafter toward the base.

22 Claims, 6 Drawing Sheets

SPADE DRILL BIT

FIELD OF THE INVENTION

The present invention relates to a drill bit. More specifically, the present invention relates to a spade-type drill bit.

BACKGROUND OF THE INVENTION

One conventional spade-type drill bit is depicted in FIGS. 1A-C. The bit 2 has a cutting head 6 situated at the end of an elongated shaft 4. The opposite end of the shaft 4 is preferably provided with hexagonal flats 5 for engagement within a conventional drill chuck. As best in FIG. 1B, the head 6 is substantially flat and is provided with cutting edges 22 and 24. A central point 16 is provided along the longitudinal axis of the bit 2. The outer periphery of the bit is provided with cutting spurs 26, 28.

In use, the point 16 of the rotating bit 2 penetrates the workpiece first and serves as a centering guide for the bit. As the bit is advances further into the workpiece, the spurs begin cutting into the material. Finally, as the bit is advanced further, the cutting edges 22, 24 begin to shave thin layers of the workpiece. The bit 2 continues to penetrate the workpiece until it is in the position shown in FIG. 2, at which point the spurs 26, 28 cut through the workpiece material. As the user of the drill bit prepares to exit the hole, the spurs 26 and 28 of conventional spade bits tend to grab the workpiece 30.

Once the outer most parts of the spurs have exited the material 30, the spurs cause the drill bit to pull itself aggressively back into the material. This is generally due to the hook angle 6 on the spurs of the spade bit, which can be about 15" in a typical bit. When the drill bit starts getting pulled into the material by the spurs, the user will frequently experience a jerk, typically referred to as grabbing. Grabbing may result in a wood blowout and splintering on the backside because the last portion of the uncut material 31 is pushed out rather than cut.

Another problem associated with this type of prior spade drill bit is that the spurs 26, 28 frequently experience high localized temperatures and high wear rates. In order to address these and other problems, a new drill bit 106 was developed as depicted in FIGS. 3A-C. This bit 106 includes a shaft 104 having hex drive features 105 at one end and terminating in a drill head 106 at the opposite end. The head 106 includes a central point 116 and two cutting edges 122, 124.

In contrast to the prior bit of FIGS. 1A-C, the cutting edges 122, 124 of the bit 102 in FIGS. 3A-C are rounded so that the edges exit the workpiece material at essentially the same time, as shown in FIG. 4. This configuration reduces the risk of blowout and splintering of a wood workpiece, and reduces the wear and temperature problems associated with the bit 2.

The head of the bit in FIGS. 3A-C can be modified as shown in FIG. 5. More specifically, center point 116' of the head 106' is threaded so that the lateral edges of the point 116' define a series of grooves 137. The threaded point 116' allows the bit to be self-feeding. In other words, as the bit of FIG. 5 is rotated, the threaded point engages the workpiece and draws the bit into the material. This feature greatly reduces the thrust force that must be applied by the user to penetrate the workpiece.

The threads on the point 116' of the bit shown in FIG. 5 can be provided in different pitches, or threads per inch. In a typical configuration, the threads will vary in the range of 16-26 TPI. A lower number of threads will cause the bit to penetrate more aggressively into the workpiece, and conversely for a greater number of threads. In one modification, the grooves 137 of the threaded point 116' can vary in depth along the length of the point. More particularly, the threads can have a greater depth at the base of the point 116' than at the tip. This feature makes the threaded tip 116' better able to withstand the impact of hitting a nail or other fastener embedded within the workpiece.

SUMMARY OF THE INVENTION

In one embodiment of the invention, a spade drill bit is provided that comprises a shaft having one end configured to be engaged to a driving tool and a cutting head attached at an opposite end of the shaft. The cutting head includes a center point having a tip and a base and a pair of cutting edges extending generally radially outwardly from the base of the center point. In one feature of the invention, the center point is threaded and includes continuous threads adjacent the tip and discontinuous threads thereafter towards the base.

In certain embodiments, the continuous threads include a tapered root, and therefore an increasing thread depth toward the tip of the center point. The tapered root arises in a side projection of the drill bit. On the other hand, the threads have a substantially constant thread depth when viewed in a plan view projection. More particularly, the center point includes opposite flat surfaces that are contiguous with the discontinuous threads. These flat surfaces define the plan view projection in which the thread depth is constant.

In a preferred embodiment, the center point includes opposite side edges interposed between the opposite flat surfaces. The discontinuous threads are defined on these opposite side edges. The cutting head preferably includes a spur defined at an outboard end of each of the cutting edges, so that the drill bit includes a pair of radially outwardly disposed spurs.

In another embodiment, the cutting head includes opposite flat surfaces and opposite sides interposed between the flat surfaces. These opposite flat surfaces are contiguous with the flat surfaces of the center point. The cutting head can include exterior thread defined in the opposite sides. The threads of said center point and the exterior threads of the cutting head preferably have substantially the same thread pitch. However, in certain embodiments, the exterior threads have a thread depth less than a thread depth of the threads of the center point.

The continuous threads extend a predetermined distance form the tip of the center point. In certain embodiments, the continuous threads extend about two revolutions from the tip. The discontinuous threads continue from the continuous threads and terminate above the base of the center point. In embodiments that include the outboard spurs, the discontinuous threads terminate at a line extending between the spurs.

It is therefore an objective of the present invention to provide an energy efficient drill bit. It is a further object of the invention to provide a drill bit design in which chips are more easily cleared out of the hole being drilled. It is yet a further object of the invention to provide a drill bit design which reduces drill vibrations and results in better quality holes.

It is yet a further object of the invention to provide a drill bit having a lower wear rate and which, during drilling, avoids excessively high localized temperatures. It is yet a further object of the invention to provide a drill bit which exits a piece of wood without grabbing the work piece as it exits the hole.

It is a further object of the invention to provide a self-threading and self-starting drill bit. These and other objects of the invention will become apparent upon consideration of the following written description taken together with the accompanying figures.

BRIEF DESCRIPTION OF THE DRAWINGS

The accompanying drawings illustrate various embodiments of the present invention and together with a description serve to explain the principles of the invention. In the drawings.

DETAIL DESCRIPTION OF THE INVENTION

Figure 1C:
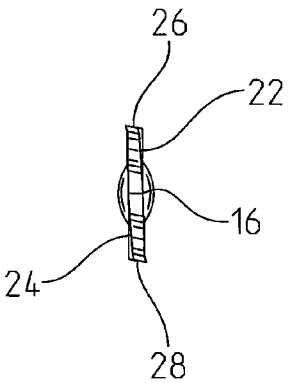
FIG. 1C (PRIOR ART)
FIGS. 1A, 1B and 1C are respectively a top view and a side and edge projection view of a conventional spade drill bit.

Reference will now be made in detail to various presently preferred embodiments of the invention, examples of which are illustrated in the accompanying drawings. In the various FIGS. some of the structures are referenced with similar reference numerals.

Figure 1A:
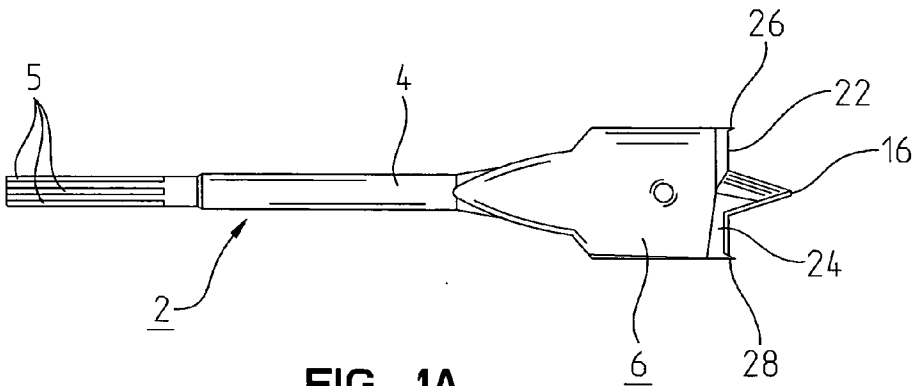
FIG. 1A (PRIOR ART)
Figure 1B:
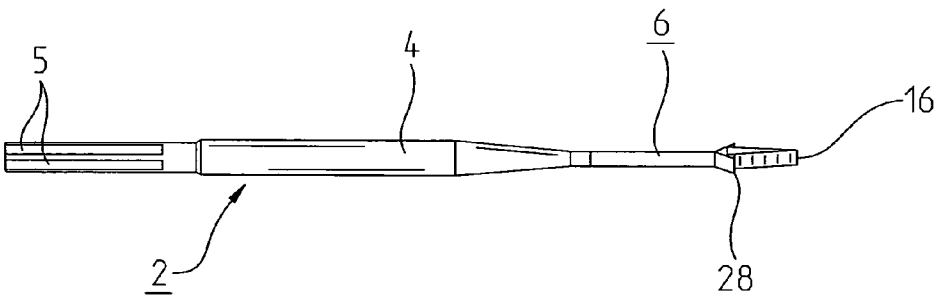
FIG. 1B (PRIOR ART)
Figure 2:
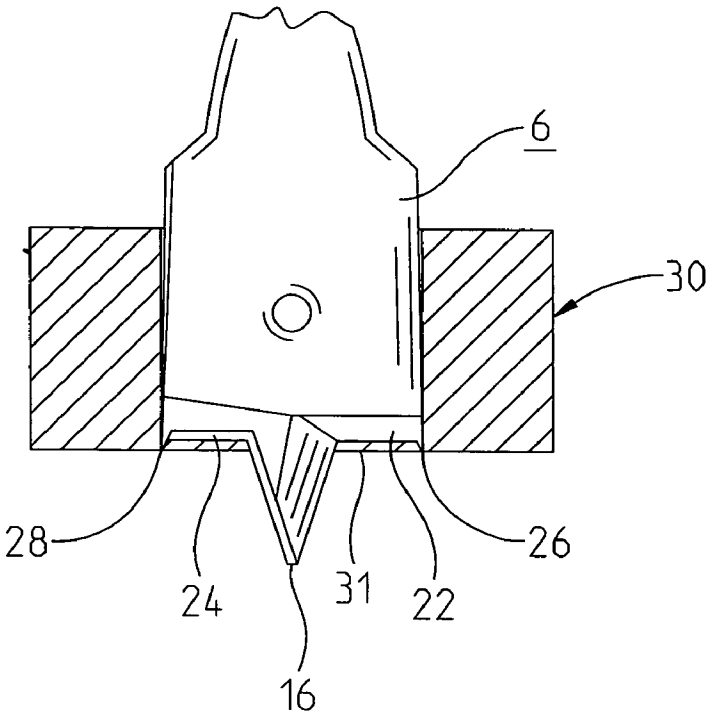
FIG. 2 (PRIOR ART)
FIG. 2 illustrates the conventional spade bit of FIGS. 1A-C exiting a wooden workpiece.
Figure 4:
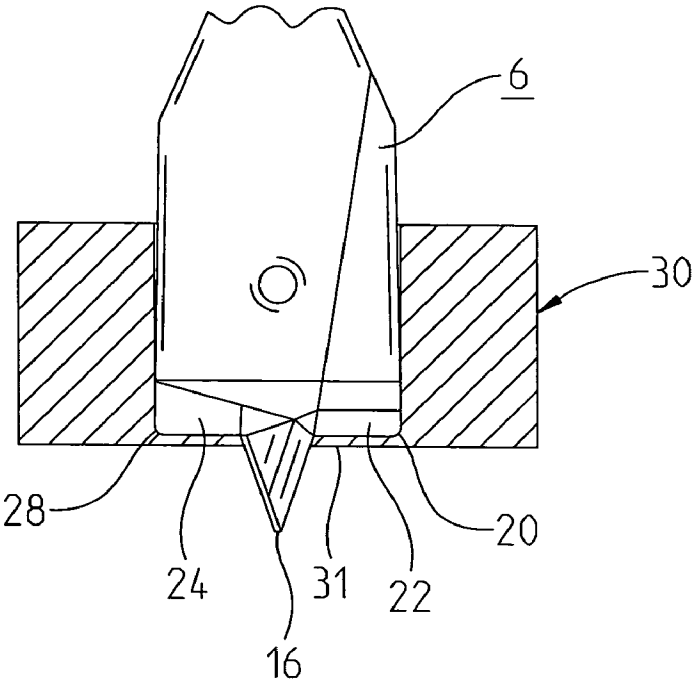
FIG. 4 (PRIOR ART)
FIG. 4 illustrates the improved spade bit of FIGS. 3A-C exiting a wooden workpiece.
Figure 3C:
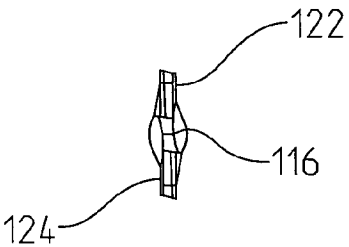
FIG. 3C (PRIOR ART)
FIGS. 3A, 3B and 3C are respectively a top view and a side and edge-wise view of an improved spade drill bit design.
Figure 3A:
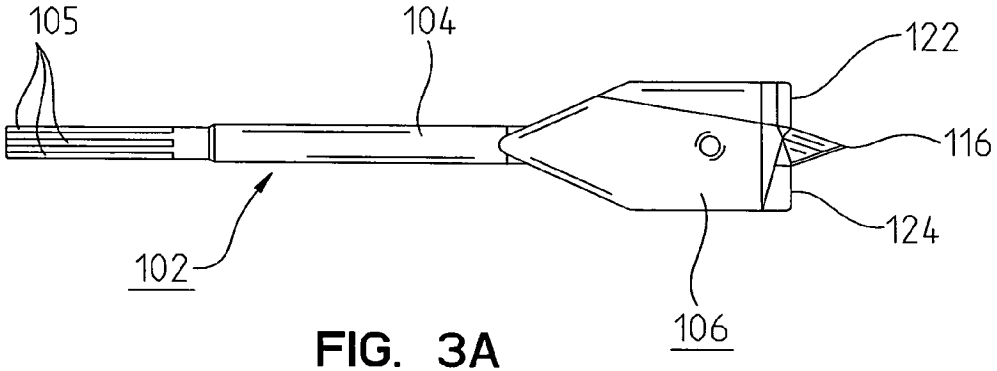
FIG. 3A (PRIOR ART)
Figure 3B:
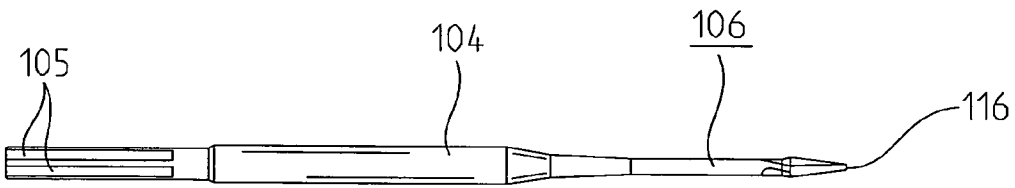
FIG. 3B (PRIOR ART)
Figure 5:
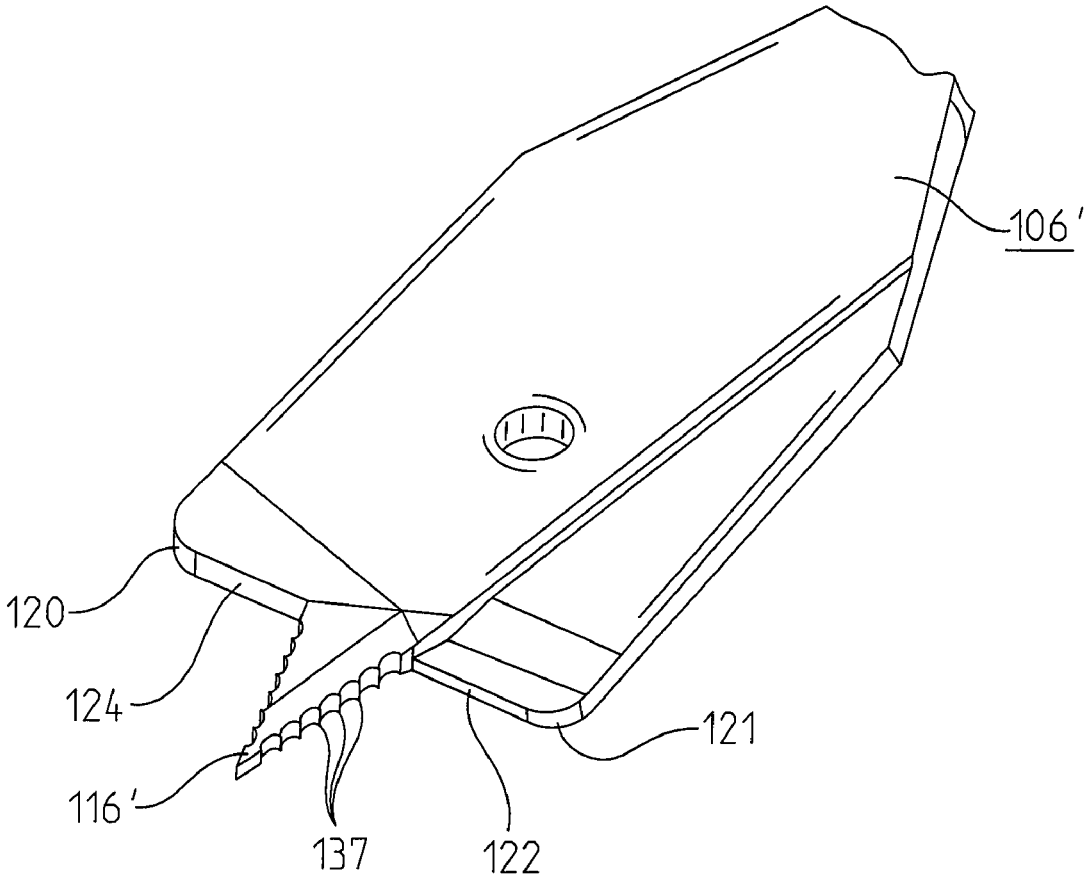
FIG. 5 (PRIOR ART)
FIG. 5 is a depiction of the improved spade bit of FIGS. 3A-C with a threaded center point.
Figure 6:
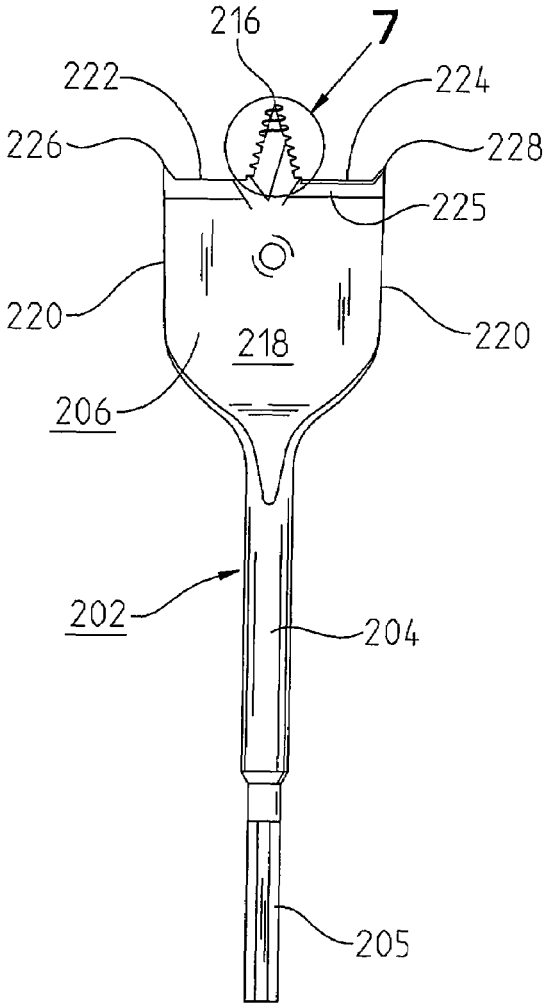
FIG. 6 is a top view of a spade drill bit in accordance with one embodiment of the present invention.

Referring to FIG. 6, one embodiment of the invention is depicted in which a spade-type drill bit 202 includes a shaft 204 terminating in a driving end 205. A cutting head 206 is formed at the opposite end of the shaft. These components of the drill bit 202 can be similar to the like components of the bits 2 and 102 in FIGS. 1A-*c* and 3A-C, respectively. In other words, the driving end 204 can have a hex configuration to mate with a drill chick and the head 206 can have a flat, spade profile. The head 206 includes a center point 216 and cutting edges 222 and 224, like both prior drill bits described above. Moreover, the head 206 of the present embodiment can include spurs 226 and 228, similar to the spurs 26 and 28 of the bit shown in FIGS. 1A-C.

Figure 9:
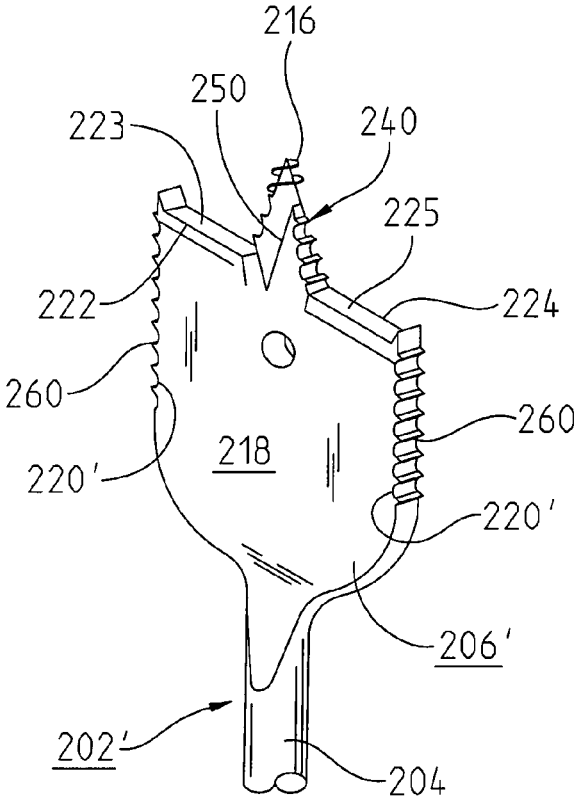
FIG. 9 is a perspective view of a spade drill bit in accordance with an alternative embodiment of the invention.

The cutting head 206 includes angled surfaces 223 and 225 corresponding to the cutting edges 222 and 224, as shown in FIG. 9. These surfaces are angled in the direction of rotation of the drill bit. The side edges 220 can include a rake angle at the upper end of the edges adjacent the angled surfaces 223, 225. These features of the drill bit 202 of the present embodiment are similar to the like features shown and described in U.S. Pat. No. 5,433,561, which disclosure is incorporated by reference.

However, the head 206 is not identical to the prior drill bits of FIGS. 1-5. For instance, in one feature of the present invention, the center point 216 is threaded, as shown in the enlarged detail views of FIGS. 7 and 8. In particular, the center point 216 includes a series of threads 240 extending substantially along the length (or height) of the point 216. In the preferred embodiment, the threads 240 extend from the tip of the center point 216 nearly to its base 217, at least where the bit 202 is a large drill bit (i.e., about 7/16 and larger). For smaller bits (i.e., about 3/8 and smaller), the threads preferably terminate above the base 217 of the center point 216, and most preferably only extend about 3/16 below the tip 218 of the center point. For large or small bits, the threads 240 preferably terminate before reaching the outer diameter of the head 206. In other words, the threads terminate at a height above the cutting edges 222, 224 that is approximately equal to the height of the spurs 226, 228 above the edges.

Figure 7:
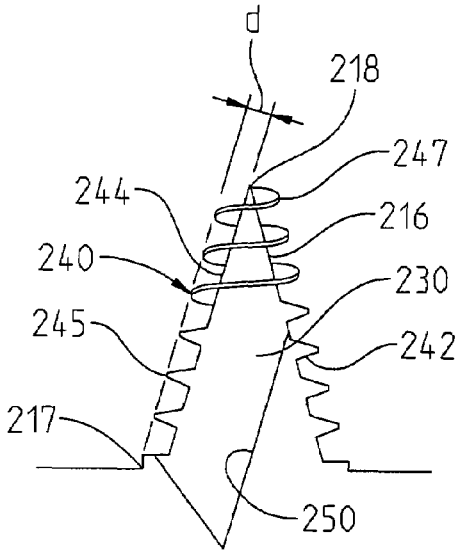
FIG. 7 is an enlarged view of the threaded point of the spade drill bit designated as area 7 in FIG. 6.

In one aspect of this embodiment, the center point 216 includes opposite flat surfaces 230 that coincide with the flat surfaces 218 of the head 206 (FIG. 6). The threads 240 then form edge-wise threads 242 along the tapered side edges of the center point, as shown in FIG. 7. These threads continue to the tip 218 of the center point. In this top projection (i.e., with the flat surfaces 218 and 230 in plan view), the threads 240 include a root 244 and crest 245 which define a thread depth d. In the preferred embodiment, this depth is constant with respect to this plan view projection of the drill bit 206. This constant depth d makes the drill bit 206 a fast starting bit that requires only minimal pressure to start in most types of wood. In a specific embodiment, this thread depth d is about 0.05 inches.

Figure 8:
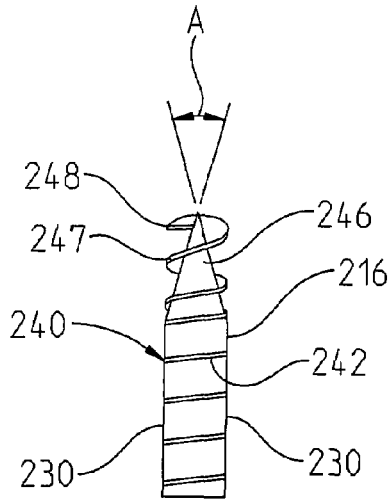
FIG. 8 is an enlarged side view of the threaded point depicted in FIG. 7.

The side view of the threaded center point 216 presents a different impression. In particular, while the majority of the point 216 includes the opposite flat surfaces 230, the portion of the point near its tip 218 is tapered. In other words, the threads 240 include a tapered root 246 near the tip 218 of the center point, as shown in FIG. 8. The root is tapered at an angle A, which in a preferred embodiment is essentially the same as the angle of taper of the center point in its plan view projection shown in FIG. 7. In a specific embodiment, this angle A is an included angle of about 28-45 degrees depending upon the size of the drill bit 206. For a 1½ inch bit, the angle A can be about 33 degrees.

The crest 247 of the threads 240 in this portion of the center point preferably fall at the same crest diameter as the crest 245 for the lower portion of the threads 240. Thus, in the side presentation of the threaded center point 216, the threads 240 exhibit an increasing depth toward the tip 218 of the center point. The threads 240 commence at a leading edge 248 which facilitates initial penetration of the threaded center point 216 into the workpiece.

The threads 240 of the center point 216 combine a self-starting feature with a self-driving feature. In other words, with the exposed leading edge 248 of the threads, the bit can easily penetrate the workpiece. The continuation of the threads along the center point 216 draws the bit toward the workpiece with only minimal thrust pressure being exerted by the user on the drill. These features of the threads 240 combine to reduce the wear experienced by the center point. Moreover, the resulting spade drill bit provides a smoother drilling action at a quicker rate than conventional prior drill bits. The smoother drilling action and feed rate generates a better quality drilled hole in the workpiece, particularly is the workpiece material is wood.

The threads 240 can be provided in different pitches depending upon the particular application for the bit. In general, lower pitch bits drill faster into the workpiece, while higher pitches result in slower drilling rates. In a specific embodiment, the threads 240 can have a pitch of 16 TPI, which is particularly well-suited for softer wood materials. On the other end of the spectrum, a pitch of 26 TPI is ideal for hard woods. It has been found that a pitch of 20 TPI is optimum for most woods used in building and construction. This thread pitch works well in both soft and hard woods, with an acknowledged decrease in drilling speed when used in hard woods.

In prior drill bits, such as the drill bit disclosed in published PCT application WO 98/05459, which disclosure is incorporated herein by reference, the center point is threaded only on the side edges of the point. This threading represents an improvement over earlier drill bits because it provided a self-feeding characteristic to the bit. The present invention represents an improvement over this feature by the inclusion of substantially continuous threads 247 at the tip 218 of the center point 216. These threads continuously penetrate the workpiece as the bit drives deeper into the material, which reduces the thrust force that must be maintained on the drill over the prior drill bits. In addition, as mentioned above, the exposed leading edge 248 of the threads 240 allows the center point 216 to initially penetrate the workpiece than the prior bit designs.

The center point 216 of the illustrated embodiment includes a further feature in the form of a flute 250 defined on the opposite flat surfaces 230 of the center point. These flutes 250 improve removal of chips generated by the center point 216 as it drills into the workpiece. As shown best in FIG. 7, this flute 250 begins just below the lower end of the continuous threads 247 and continues into the flat surface 218 of the head 206, just below the cutting edges 222, 224. When the center point is initially engaged with the workpiece, the continuous threads pump the chip material upward through the brief extent of the continuous threads 247. As the center point penetrates further into the workpiece, the chip volume increases. Absent the flute 250, the increasing chip volume would tend to clog the initial bored hole formed by the center point, thereby increasing the required thrust force, increasing the heat build-up in the bore, and decreasing the life of the threaded center portion 216. Thus, the flute 250 relieves the drilled hole of the chip material as quickly as possible, while still preserving the beneficial features of the continuous threads 247.

In the embodiment of FIG. 6, the drill bit 202 includes smooth sides 220. In an alternative embodiment of the invention shown in FIG. 9, a drill bit 202' includes threads 260 defined in the comparable sides 220'. As shown in FIG. 9, the drill bit 202' can include similar features to the bit 202 shown in FIG. 6. However, as can be seen in FIG. 9, the sides include a series of grooves 260 substantially along the entire extent of the sides 220'. These grooves 260 can be formed in lathe machine configured to turn threads. Thus, the grooves 260 on the opposite sides 220' of the head 206' essentially constitute segments of a helical thread running the length of the head 206'.

These outer threads 260 pick up where the threads 240 of the center point 216 leave off. In other words, once the spurs 224, 226 contact the workpiece, the threads 260 of the head 206' engage the workpiece material and help drive the bit into the workpiece. The threads 260 continue to draw the bit into the workpiece as the cutting edges 222, 224 begin shaving workpiece material.

One benefit provided by the outer threads 260 is realized when the spurs 226, 228 reach the end of the workpiece bore. As explained in the PCT publication WO 98/05459 discussed above, one problem with spurs on spade drill bits is that the spurs tend to cause grabbing near the end of the cut. It has been found that the addition of the threads 260 to the sides 220' of the bit head 206' helps maintain a smooth advance of the drill bit through the material, even as the bit breaks through the opposite side of the workpiece.

Preferably, the threads 260 follow the same thread pitch as the threads 240 of the center point 216. On the other hand, the threads 260 preferably have a shallower thread depth than the threads of the center point. In a preferred embodiment, the threads 260 have a depth about half the depth d of the center point threads 240. In a specific embodiment, the threads 260 have a depth of about 0.20-0.25 inches. This shallower thread depth is preferable because the threads 260 are sweeping through a larger circumferential path than the threads of the tapered center point 216.

The extent of the continuous threads can be varied depending upon the particular drill application. In the most preferred embodiment, the continuous threads 240 extend for about two revolutions for a standard thickness drill bit (i.e., about 0.080 inches thick). The extent of the continuous threads 247 can also depend upon the length (or height) of the center point. In the typical spade bit, the center point 216 projects about 0.50 inches above the cutting edges 222, 224 of the head 206. In this typical case, the continuous threads 247 extend about 0.10 inches from the tip 218.

Figure 10:
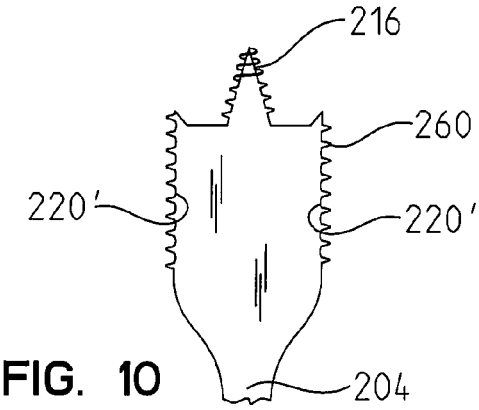
FIG. 10 is a representation of the drill it shown in FIG. 9 with the side edges substantially parallel.
Figure 11:
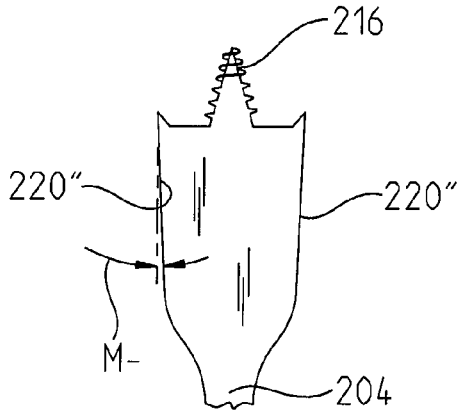
FIG. 11 is a representation of the drill it shown in FIG. 9 with the side edges converging toward the shaft of the bit.
Figure 12:
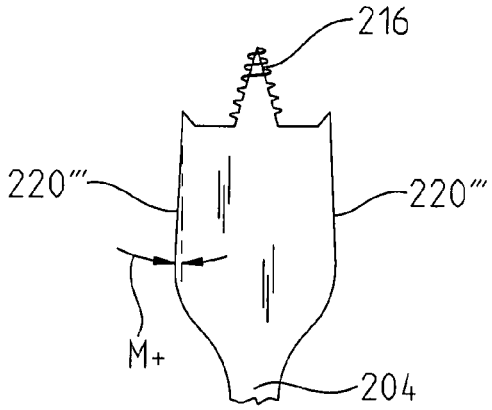
FIG. 12 is a representation of the drill it shown in FIG. 9 with the side edges diverging toward the shaft of the bit.

In the preferred embodiment, the sides 220' of the drill bit 202' are substantially parallel, as shown in FIG. 10. However, it is contemplated that the sides bearing the threads 260 can be arranged at alternative orientations, as shown in FIGS. 11 and 12. Specifically, as depicted in FIG. 11, the sides 220" can converge toward the bit shaft 204 at an angle $M^-$. This convergence can commence at the spurs or can begin downstream of the cutting edges 222, 224.

Alternatively, the sides 220'" can diverge toward the bit shaft 204, as shown in FIG. 12. Thus, the sides 220'" can diverge at an angle $M^+$. (It is understood that the threads 260 are also present on the sides 220" and 220'"). Preferably both the converging and diverging angles are on the order of about 1 degree. The diverging sides 220'" can help stabilize the drill bit as it drives deeper into the workpiece. On the other hand, the converging sides 220" can reduce the force required for the rotating drill bit to penetrate into the workpiece. The threaded diverging sides 220'" can also produce a smoother or "cleaner" bore through the workpiece as the increasing diameter of the diverging threads gradually widen the bore. The selection of the parallel 220', converging 220", or diverging 220'" sides can depend upon the nature of the workpiece material and on the driving torque of the drill to which the drill bit is engaged. For instance, where the drill is a portable electric drill, it may be desirable to minimize the driving force and drilling time, so the converging drill of FIG. 11 bit may be preferable. On the other hand, where a more powerful drill is available, the diverging drill bit of FIG. 12 may be desirable.

The drill bits of the illustrated embodiments can be formed according to known processes, such as the process described in U.S. Pat. No. 5,433,561, which has been incorporated by reference. The outer threads 260 on the sides 220 of the drill head 206 are preferably formed using a lathe configured for producing helical threads. The threads 240 on the center point are preferably formed using a tapered thread cutting die. It is understood that the tapered die will not cut threads in the flat surfaces 230 of the center point, since these surfaces reside below the tapered diameter of the center point. On the other hand, the portion of the center point adjacent the tip 218 will maintain its circular tapered configuration since the tapered diameter at this portion is less than the thickness of the bit head 206.

The embodiments illustrated were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

For instance, the outer threads 260 may be used alone, in combination with the threads 240 of the center point, or not at all, depending upon the requirements of the drill bit. In smaller bits, it is preferable to use only the threaded center point, without the threads on the sides of the bit head. However, in accordance with the present invention, one constant among the contemplated embodiments is the provision of the continuous threads at the tip 218 of the center point that merge into the discontinuous threads at the flat surface portion of the center point.

The illustrated embodiments are best suited for drilling through wood materials. The wood materials can range from soft to hard woods, with appropriate changes to the various dimensions, as mentioned above. It is contemplated that these bits can have application for boring through other materials having similar properties to wood materials.

What is claimed is:

1. A bit, comprising:
a driving end portion;
a shank connected to said driving end portion;
a blade attached to said shank, said blade having a pair of parallel opposite faces connected by a pair of outer sides being generally parallel to said shank;
a pair of lateral shoulders extending inwardly from said outer sides and converging at a central point portion to form a leading end of said blade; and
a cutting edge portion forged along the leading end of said blade, wherein a portion of said blade is forwardly bent in the direction of rotation, and wherein each of said lateral shoulders is forwardly bent from said respective outer sides to said central point portion,
wherein said central point portion has defined therein a first plurality of discontinuous threads and a plurality of continuous threads, wherein:
said central point portion includes a tip and a base,
said plurality of continuous threads are positioned adjacent to said tip of said central point portion, and
said first plurality of discontinuous threads are interposed between said plurality of continuous threads and said base of said central point portion.

2. The bit of claim 1, wherein said plurality of continuous threads include a tapered root.

3. The bit of claim 1, wherein said central point portion includes opposite flat surfaces contiguous with said first plurality of discontinuous threads.

4. The bit of claim 3, wherein said central point portion includes opposite side edges interposed between said opposite flat surfaces, and said first plurality of discontinuous threads are defined in said opposite side edges.

5. The bit of claim 4, wherein a first depth of said first plurality of discontinuous threads is constant.

6. The bit of claim 5, wherein:
a second depth of a portion of said plurality of continuous threads is constant, and
said first depth is equal to said second depth.

7. The bit of claim 1, wherein said blade has a pair of cutting spurs projecting upwardly from said lateral shoulders of said blade, said cutting spurs being located at a pair of locations where said lateral shoulders intersect with said outer sides, wherein each of said cutting spurs is forwardly bent in the direction of rotation so as to be in a coplanar relationship with said cutting edge portion.

8. A bit, comprising:
a driving end portion;
a shank connected to said driving end portion;
a blade attached to said shank, said blade having a pair of parallel opposite faces connected by a pair of outer sides being generally parallel to said shank;
a pair of lateral shoulders extending inwardly from said outer sides and converging at a central point portion to form a leading end of said blade;
a cutting edge portion forged along the leading end of said blade, wherein a portion of said blade is forwardly bent in the direction of rotation, and wherein each of said lateral shoulders is forwardly bent from said respective outer sides to said central point portion,
wherein said central point portion has defined therein a first plurality of discontinuous threads, wherein each of said pair of parallel opposite faces are configured to be flat, and wherein a second plurality of discontinuous threads are defined in said pair of outer sides of said blade.

9. The bit of claim 8, wherein said first plurality of discontinuous threads and said second plurality of discontinuous threads have substantially equal thread pitch.

10. The bit of claim 8, wherein:
said first plurality of discontinuous threads of said central point portion has a first thread depth,
said second plurality of discontinuous threads of said blade has a second thread depth, and
said first thread depth is greater than said second thread depth.

11. The bit of claim 8, wherein said pair of outer sides of said blade are configured to diverge away from said shank.

12. The bit of claim 8, wherein said pair of outer sides of said blade are configured to converge toward said shank.

13. The bit of claim 1, wherein said plurality of continuous threads extend about two revolutions from said tip of said central point portion.

14. The bit of claim 1, wherein said first plurality of discontinuous threads of said central point portion terminate above said base of said central point portion.

15. The bit of claim 1, wherein said central point portion includes at least one flute defined therein that is spaced apart from said plurality of continuous threads.

16. The bit of claim 3, wherein:
said central point portion includes at least one flute defined in each of said opposite flat surfaces, and
said at least one flute commences between said plurality of continuous threads and said base of said central point portion.

17. The bit of claim 1, wherein said cutting edge portion forms an axial rake angle extending along said lateral shoulder at about 15 degrees with respect to a plane perpendicular to said parallel opposite faces of said blade.

18. The bit of claim 1, wherein said cutting edge portion has a beveled cutting edge.

19. The bit of claim 3, wherein said opposite flat surfaces are generally in the shape of a triangle when viewed in plan.

20. A bit, comprising:

a driving end portion;

a blade operably attached to said driving end portion, said blade having a pair of faces connected by a first outer side and a second outer side, a portion of said blade forwardly bent in the direction of rotation;

a first lateral shoulder extending inwardly from said first outer side to form a first leading end portion of said blade, at least a portion of said first lateral shoulder forwardly bent in said direction of rotation;

a second lateral shoulder extending inwardly from said second outer side to form a second leading end portion of said blade, at least a portion of said second lateral shoulder forwardly bent in said direction of rotation;

a first cutting edge portion located at said first leading end portion of said blade and a second cutting edge portion located at said second leading end portion of said blade; and a central point portion located between said first and said second lateral shoulders and extending outwardly from said blade and defining at least one continuous thread and at least one discontinuous thread.

21. The bit of claim 20, wherein the at least one continuous thread extends for at least about two revolutions.

22. The bit of claim 20, wherein said central point portion includes opposite flat surfaces contiguous with said first plurality of discontinuous threads.

* * * * *